US007835677B2

(12) United States Patent
Sakata et al.

(10) Patent No.: US 7,835,677 B2
(45) Date of Patent: Nov. 16, 2010

(54) DEVELOPING DEVICE, IMAGE FORMING APPARATUS, AND PROCESS CARTRIDGE

(75) Inventors: Koichi Sakata, Numazu (JP); Tomio Kondou, Numazu (JP); Shinichiro Yagi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 64 days.

(21) Appl. No.: 12/402,086

(22) Filed: Mar. 11, 2009

(65) Prior Publication Data

US 2009/0232532 A1 Sep. 17, 2009

(30) Foreign Application Priority Data

Mar. 17, 2008 (JP) ..... 2008-068576
Sep. 16, 2008 (JP) ..... 2008-235954

(51) Int. Cl.
*G03G 15/09* (2006.01)

(52) U.S. Cl. ..... 399/276

(58) Field of Classification Search ..... 399/119, 399/252, 258, 265, 267, 276, 277; 430/111.31, 430/111.35, 111.41
See application file for complete search history.

(56) References Cited

U.S. PATENT DOCUMENTS 7,003,235 B2 * 2/2006 Azami et al. ..... 399/30
7,381,513 B2 6/2008 Suzuki et al.
7,592,116 B2 * 9/2009 Suzuki et al. ..... 430/111.35
7,664,439 B2 * 2/2010 Sugiura ..... 399/267
2006/0210906 A1 9/2006 Suzuki et al.
2007/0015078 A1 1/2007 Suzuki et al.
2008/0063433 A1 3/2008 Miyamoto et al.
2008/0096121 A1 4/2008 Iwatsuki et al.
2008/0152393 A1 6/2008 Nagayama et al.
2008/0171274 A1 7/2008 Yagi et al.
2008/0213684 A1 9/2008 Nagayama et al.

FOREIGN PATENT DOCUMENTS

JP 2003-228240 8/2003
JP 2006-184891 7/2006
JP 3942139 4/2007

* cited by examiner

*Primary Examiner*—Hoan Tran
(74) *Attorney, Agent, or Firm*—Oblon, Spivak, McClelland, Maier & Neustadt, L.L.P.

(57) ABSTRACT

Provided is a developing device containing a two-component developer including a magnetic carrier and a toner; a developer bearing member containing a nonmagnetic developing sleeve configured to bear the two-component developer on a surface thereof while rotating; a magnetic field generating unit fixed inside of the nonmagnetic developing sleeve; and a developer amount control member configured to control an amount of the two-component developer borne on the developer bearing member. The magnetic carrier contains a core material and a coating layer coated on the core material, and the coating layer containing a binder resin and conductive particles. The magnetic carrier satisfy a ratio D/h of 1.00<[D/h]≦1.95, where D denotes an average primary particle diameter of the conductive fine particles, and h denotes a thickness of the coating layer, and a ratio Ra/D of 1.0<[Ra/D]<10.0, where Ra denotes a surface roughness of the developing sleeve.

10 Claims, 6 Drawing Sheets

DEVELOPING DEVICE, IMAGE FORMING APPARATUS, AND PROCESS CARTRIDGE

BACKGROUND OF THE INVENTION

1. Field of the Invention

The present invention relates to a developing device to be used for electrostatic charge image development in electrophotography, and an image forming apparatus and a process cartridge using the developing device.

2. Description of the Related Art

In image forming processes such as electrophotography and electrostatic photography, a developer that is obtained by mixing and stirring toner and carrier is generally used for developing a latent electrostatic image formed on a latent image bearing member. The developer is required to be a mixture having been charged.

There are generally known two methods for developing latent electrostatic images: a method using a two-component developer obtained by mixing toner and carrier; and a method using a one-component developer not including carrier. The former developing method using a two-component developer enables obtaining relatively stable and excellent images, while it has a drawback that carrier deterioration and a fluctuation in the mixing ratio of the toner and carrier are likely to occur. On the other hand, the latter method using a one-component developer does not have such a drawback as in the former method but has an inconvenience that the electrostatic property is hard to stabilize.

When repeatedly carrying out development of latent images using a two-component developer, toner in the developer is consumed to cause fluctuation in toner concentration, so that for obtaining stable images at the time of printing, it is necessary to replenish the developer with toner according to necessity so as to suppress the fluctuation.

As a method for controlling the amount of toner replenishment, copiers are generally equipped with permeability detecting sensors, fluidity detecting sensors, image density detecting sensors, bulk density detecting sensors, and the like, and recently, image density sensors have been predominately used. These sensors use a system for controlling the amount of toner replenishment by developing a regular image pattern on the latent image bearing member and detecting image density from reflected light.

For a particulate carrier to be used in such a two-component developing system, a hard and high-strength coating layer has been provided, usually, by coating with a suitable resin material for the purpose of preventing toner filming onto the carrier surface, forming a uniform carrier surface, preventing surface oxidation, preventing a decrease in moisture sensitivity, extending the service life of the developer, protecting the photoconductor from scratches or wear caused by the carrier, controlling charge polarity, adjusting the charge amount, or the like.

As examples of such carriers according to related arts, disclosed is a carrier in which the core surface is coated with a particular resin material (refer to Japanese Patent Application Laid-Open (JP-A) No. 58-108548), carriers in which various additives are added to the coating layers (Japanese Patent Application Laid-Open (JP-A) Nos. 54-155048, 57-40267, 58-108549 and 59-166968, Japanese Patent Application Publication (JP-B) No. 01-19584 and 03-628, and JP-A No. 06-202381), a carrier for which an additive is adhered to the surface (JP-A No. 05-273789), and a carrier in which the coating layer includes conductive particles larger in diameter than the thickness of the coating layer (JP-A No. 09-160304).

There are also known methods: in which a coating material whose main component is a benzoguanamine n-butyl alcohol formaldehyde copolymer is used for a carrier (see JP-A No. 08-6307); and in which a crosslinked acrylic resin and melamine resin is used as a coating material (Japanese Patent (JP-B) No. 2683624).

However, the carriers according to the related arts mentioned above are still insufficient in durability, and there is a problem such as a decrease in resistance due to scraping of the coating layer. More specifically, although satisfactory images can be initially obtained, the quality of copy images degrades as the number of copies increases, so that a further improvement has been demanded.

Therefore, a method has been proposed for solving these problems by dispersing, in the coating layer of a core, fine particles having a particle diameter equal to or more than the thickness of the coating layer (JP-A No. 2001-188388).

However, in this proposal, while the durability is improved, a problem of a rise in resistance of the developer on the magnetic brush occurs. If the carrier resistance rises, counter charge remaining in the carrier after development becomes hard to dissipate, so that carrier adhesion to a solid edge portion occurs. In an image portion, an electric field where the toner transfers from the developing sleeve surface toward the photoconductor drum is formed. In a non-image portion, an electric field where the toner transfers toward the photoconductor drum disappears.

Moreover, in an edge portion being a boundary between the image portion and the non-image portion, an edge electric field being an electric field where the carrier adheres to the photoconductor drum to the contrary is formed. The intensity of the edge electric field becomes stronger at a higher carrier resistance, and becomes weaker, at a lower carrier density. Therefore, usually used is one whose coating layer contains a conductive substance for the purpose of resistance control. However, contact probability of the coating layer decreases because of the existence of particles having a larger particle diameter than the thickness of the coating layer, and a sufficient effect of the conductive substance cannot be obtained. The resistance of the developer therefore rises.

Moreover, the contact area between the sleeve and the carrier also decreases, and thus counter charge becomes harder to dissipate.

In order to solve these problems, there has been proposed a method for lowering the resistance of a developer by providing a conductive coating layer containing fine particles having a particle diameter equal to or more than the thickness of the coating layer (JP-A No. 2006-184891). This proposal has revealed that the edge effect can be suppressed. However, the proposed method is not sufficient to dissipate counter charge by itself.

Meanwhile, among a large number of conventional arts relating to electrophotographic developer technologies, there are relatively few arts that disclose particularly preferred correlations between the surface condition of carrier particles and the surface roughness of the developing sleeve. For example, the inventor of the present application has before proposed an image forming apparatus in which the developing sleeve of the two-component developing device has a surface roughness (Rz) of 5 μm to 20 μm, the magnetic carrier has a coating layer including a binder resin and particles, the particles have a diameter D and the coating layer has a thickness h where $1<D/h<10$, and the magnetic carrier has a weight average particle diameter d of 20 μm to 60 μm (JP-A No. 2003-228240). However, "d" of d/Rz provided in this proposal means an average particle diameter d of the carrier particles, while "D" of Ra/D of the invention of the present application means a particle diameter D of the conductive fine particles in the coating layer. Moreover, this proposal describes the "sleeve surface roughness Rz" and the "particle diameter D of the conductive fine particles," but does not describe the "sleeve surface roughness Ra," so that an Ra value cannot be strictly determined from an Rz value. Furthermore, the proposed technology aims to stabilize the scooping amount of the developer, while the invention of the present application aims to provide a developing technology for images excellent in durability while suppressing image defects such as carrier adhesion, and therein fundamentally differs therefrom. Moreover, in the examples of the proposal, only Experiment 4 describes both of the particle diameter of the conductive fine particles and the surface roughness of the developing sleeve, however, there exist only examples where D/h is 2.0 or more.

Therefore, the proposal of JP-A No. 2003-228240 does not reveal any features of the invention of the present application.

BRIEF SUMMARY OF THE INVENTION

It is an object of the present invention to provide a developing device, an image forming apparatus, and a process cartridge capable of forming fine-grained images excellent in durability and free from edge effects for a long period of time and in which image defects such as carrier adhesion do not occur for a long period of time.

The means for solving the above-mentioned problems are as follow.

<1> A developing device containing: a two-component developer containing a magnetic carrier and a toner; a developer bearing member containing a nonmagnetic developing sleeve configured to bear the two-component developer on a surface thereof while rotating; a magnetic field generating unit fixed inside of the nonmagnetic developing sleeve; and a developer amount control member configured to control an amount of the two-component developer borne on the developer bearing member, wherein the magnetic carrier contains a core material, and a coating layer coated on the core material and containing a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D)]<10.0$, where Ra denotes a surface roughness of the developing sleeve.

<2> The developing device according to <1>, wherein the core material has coverage of 70% or more with the conductive fine particles.

<3> The developing device according to <1>, wherein the developing sleeve has a surface processed by blasting.

<4> The developing device according to <1>, wherein the magnetic carrier has a volume resistivity of 10 [Log(Ω·cm)] to 16 [Log(Ω·cm)].

<5> The developing device according to <1>, wherein the magnetic carrier has a volume average particle diameter of 20 μm or more and 65 μm or less.

<6> The developing device according to <1>, wherein the binder resin includes a silicone resin.

<7> The developing device according to <1>, wherein the binder resin includes an acrylic resin and a silicone resin.

<8> The developing device according to <1>, wherein the magnetic carrier has a magnetic moment of 40 $Am^2/kg$ to 90 $Am^2/kg$ or less at 1,000 $10^3/4\pi \cdot A/m$.

<9> An image forming apparatus containing: a latent electrostatic image bearing member; a latent electrostatic image forming unit configured to form a latent electrostatic image on the latent electrostatic image bearing member; a developing unit configured to develop the latent electrostatic image using a toner so as to form a visible image; a transferring unit configured to transfer the visible image onto a recording medium; and a fixing unit configured to fix the transferred image onto the recording medium, wherein the developing unit contains: a two-component developer containing a magnetic carrier and the toner; a developer bearing member containing a nonmagnetic developing sleeve configured to bear the two-component developer on a surface thereof while rotating; a magnetic field generating unit fixed inside of the nonmagnetic developing sleeve; and a developer amount control member configured to control an amount of the two-component developer borne on the developer bearing member, wherein the magnetic carrier contains a core material, and a coating layer coated on the core material and containing a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D]<10.0$, where Ra denotes a surface roughness of the developing sleeve.

<10> A process cartridge containing: a latent electrostatic image bearing member; and a developing unit configured to develop a latent electrostatic image formed on the latent electrostatic image bearing member using a toner so as to form a visible image, wherein the process cartridge is detachably mounted to an image forming apparatus body, wherein the developing unit contains: two-component developer containing a magnetic carrier and the toner; a developer bearing member containing a nonmagnetic developing sleeve configured to bear the two-component developer on a surface thereof while rotating; a magnetic field generating unit fixed inside of the nonmagnetic developing sleeve; and a developer amount control member configured to control an amount of the two-component developer borne on the developer bearing member, wherein the magnetic carrier contains a core material, and a coating layer coated on the core material and containing a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D]<10.0$, where Ra denotes a surface roughness of the developing sleeve.

According to the present invention, a developing device, an image forming apparatus, and a process cartridge capable of forming fine-grained images excellent in durability and free from edge effects for a long period of time and in which image defects such as carrier adhesion do not occur for a long period of time can be provided.

DETAILED DESCRIPTION OF THE INVENTION

Developing Device

Figure 1:
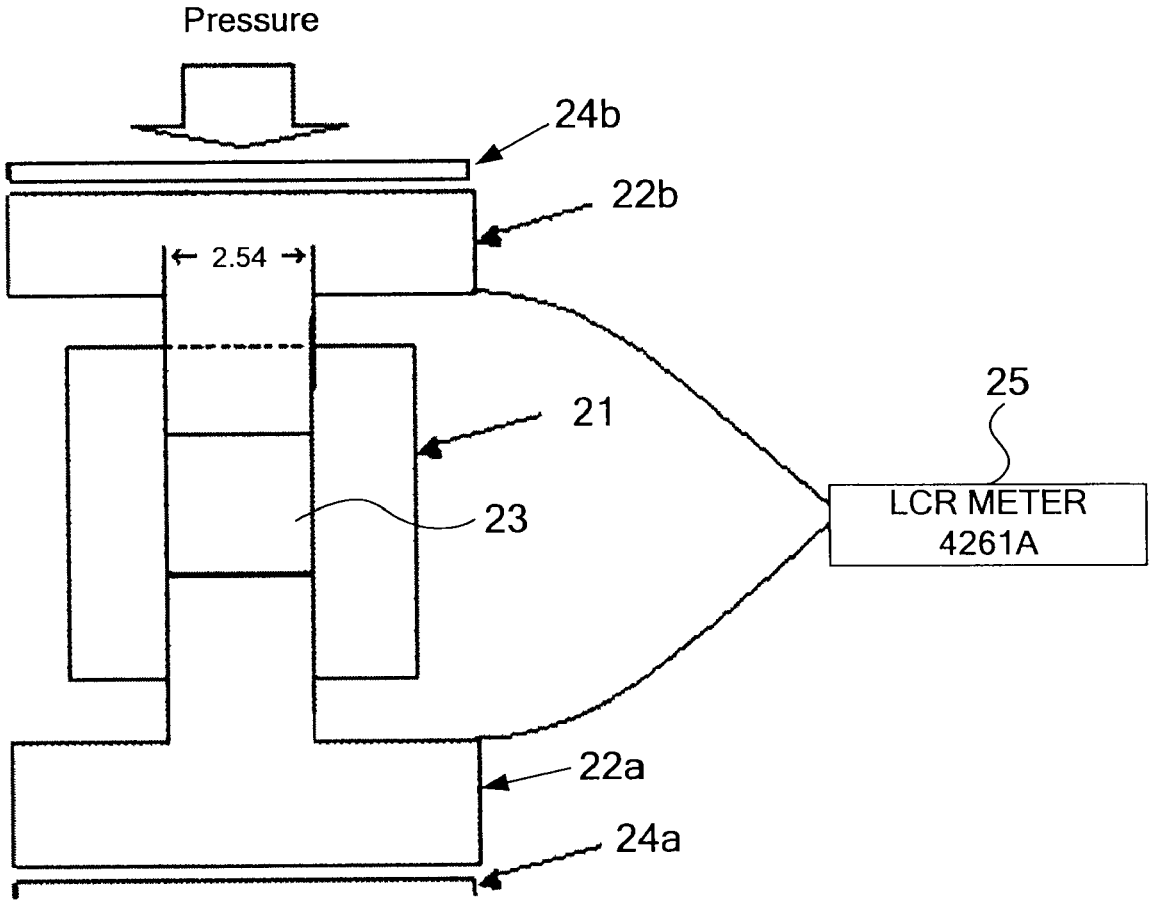
FIG. 1 is a schematic view of a powder resistivity measuring device.

A developing device of the present invention includes a developer bearing member containing a nonmagnetic developing sleeve configured to bear a two-component developer including a magnetic carrier and toner on its surface while rotating, a magnetic field generating unit fixed inside of the nonmagnetic developing sleeve, and a developer amount control member for controlling the amount of the developer borne on the developer bearing member, and further includes other members according to necessity.

The magnetic carrier includes a core material and a coating layer coated on a core material, and the coating layer contains a binder resin and conductive fine particles. The magnetic carrier satisfies a ratio D/h of $1.00<[D/h]\leqq 1.95$, and preferably $1.05\leqq[D/h]\leqq 1.45$, where D denotes an average primary particle diameter of the conductive fine particles, and h denotes a thickness of the coating layer.

If the ratio D/h is 1.00 or less, since the conductive fine particles are buried in the binder resin, a number of the conductive fine particles to be protruded on the carrier surface are reduced, and thus a cleaning effect to efficiently scrape away a spent component of the toner adhered to the carrier surface by frictional contact between the carriers decreases, and an effect to prevent toner spent considerably decreases, which is not preferable. Moreover, the binder resin layer (coating layer) is easily scraped since there are few conductive fine particles to be protruded, and there is a problem of a large decrease in resistance when the carrier is stirred for a long time.

On the other hand, if the ratio D/h is more than 1.95, a sufficient binding force cannot be obtained because of a small contact area between the conductive fine particles and the binder resin, so that the conductive fine particles are easily desorbed, which is thus not preferable. In the case of desorption, the conductive fine particles cause a decrease in resistance.

The thickness h of the coating layer is preferably 0.2 μm to 0.4 μm.

The average primary particle diameter D of the conductive fine particles is preferably 100 nm to 300 nm.

The thickness h of the coating layer is determined from an average value of measurements obtained by measuring the thickness of a resin portion of the coating layer coating the carrier surface while observing a carrier section with a transmission electron microscope (TEM). Concretely, only the thickness of a resin portion existing between the core surface and the conductive fine particles is measured. The thickness of a resin portion between conductive fine particles and the thickness of a resin portion existing on inorganic fine particles (conductive fine particles) are not included in the measurements. An average of measurements at an arbitrary 50 points in the carrier section is determined and provided as a thickness h (μm). The average primary particle diameter (D) of the conductive fine particles is measured as a volume average particle diameter by an automatic particle size distribution analyzer CAPA-700 (manufactured by HORIBA, Ltd.) in the same manner as the primary particle diameter Df of conductive fine particles to be described later.

The magnetic carrier satisfies a ratio (Ra/D) of $1.0<[Ra/D]<10.0$, preferably $2.0\leqq[Ra/D]\leqq 5.0$, and more preferably $2.0\leqq[Ra/D]\leqq 3.0$, where D denotes the average primary particle diameter of the conductive fine particles as mentioned above, and Ra denotes a surface roughness of the developing sleeve.

If the ratio Ra/D is 1.0 or less, since a contact region between the conductive fine particles and the sleeve is insufficient, resistance of the magnetic brush does not sufficiently decrease, and a problem such as carrier adhesion is likely to occur since counter charge does not sufficiently dissipate. If the ratio Ra/D is 10.0 or more, unevenness of the sleeve surface is so large that the conductive fine particles do not sufficiently contact the sleeve. Therefore, resistance of the magnetic brush does not sufficiently decrease, and a problem such as carrier adhesion occurs since counter charge does not sufficiently dissipate.

The surface roughness Ra of the developing sleeve is preferably 0.8 to 1.4.

In order to adjust the surface roughness Ra of the developing sleeve to the range mentioned above, for example, blasting, grooving processing, grinding, a sandpaper method, index saver processing or the like may be used. Among these, blasting is simple in operation and excellent in processing efficiency, and thus considered to equally improve frictional resistance between the developer and the developing sleeve in all directions. Accordingly, the scooping amount can be unified without unevenness, thereby preventing unevenness in concentration to realize a high image quality.

The surface roughness Ra means a centerline average surface roughness, which is measured by SURFCORDER SE-30H, manufactured by Kosaka Laboratory Ltd. The centerline average roughness closely reflects the depth of a minute unevenness of a solid surface. Moreover, the material of the developing sleeve to be used is not particularly limited, as long as it is one that is used for conventional developing devices. Concretely, nonmagnetic materials such as stainless steel, aluminum, and ceramic, furthermore, these nonmagnetic materials applied with coating or the like, etc., are used.

The shape of the developing sleeve is also not particularly limited.

The above-mentioned coating layer contains the conductive fine particles, and coverage of the core material with the conductive fine particles is preferably 70% or more, and more preferably 70% to 95%. The reason for making the coating layer contain the conductive fine particles is to form unevenness on the carrier surface, thereby allowing, by stirring for triboelectric charging of the developer, relieving contact involving a strong impact on the binder resin by friction with the toner or friction between the carriers. This makes it possible to prevent toner spent to the carrier.

If the coverage of the core material is less than 70%, there is a high probability that the surface of the carrier core material is exposed due to film scraping with time, a decrease in resistance locally occurs, and carriers in which such a condition exists are developed in a solid image, so that white voids occur in the image.

The coverage is a ratio of the core material being covered with the conductive fine particles, and expressed by the following formula.

$$\text{Coverage}=(Ds\times\rho s\times W)/(4\times Df\times\rho f)\times 100$$

(Ds: particle diameter of carrier core material, ρs: true specific gravity of carrier core material, W: ratio of additive amount of conductive fine particles to carrier core material, Df: particle diameter of conductive particles, ρf: true specific gravity of conductive particles)

The true specific gravity ρf of the conductive fine particles and the true specific gravity ρs of the carrier core material are measured using a dry automatic bulk density meter (Micromeritics Gas Pycnometer Accupyc 1330, manufactured by SHIMADZU CORPORATION). The particle diameter Ds (volume average particle diameter) of the carrier core material can be measured using an SRA type of Microtrac Particle-Size Analyzer (manufactured by NIKKISO CO., LTD.). One with a range setting of 0.7 μm or more and 125 μm or less is used.

Moreover, methanol is used for a dispersion liquid, the refractive index of which is set to 1.33, and the refractive index of the carrier and core material is set to 2.42. The particle diameter Df of the conductive fine particles is measured as a volume average particle diameter by an automatic particle size distribution analyzer CAPA-700 (manufactured by HORIBA, Ltd.).

As a pretreatment of measurement, 30 ml of aminosilane (SH6020: manufactured by Dow Corning Toray Silicone Co., Ltd.) and 300 ml of a toluene solution are charged in a juicer mixer, 6.0 g of a sample is added thereto, and the rotation speed of the mixer is set to low to carry out dispersion for three minutes. The dispersion liquid is added in an appropriate amount to 500 ml of a toluene solution prepared in advance in a 1000 ml beaker and diluted. The diluted solution is always continuously stirred by a homogenizer. The diluted solution is measured by an ultra-centrifugal automatic particle size distribution analyzer CAPA-700.

<Measuring Conditions>

Rotation speed: 2000 rpm

Maximum particle size: 2.0 μm

Minimum particle size: 0.1 μm

Pitch of particle size: 0.1 μm

Viscosity of dispersion medium: 0.59 mPa·s

Density of dispersion medium: 0.87 g/cm$^3$

Particle density: The density of conductive fine particles is input with a true specific gravity value measured using a dry automatic bulk density meter (Accupyc 1330, manufactured by SHIMADZU CORPORATION).

Volume resistivity of the carrier is preferably 10 [Log (Ω·cm)] to 16 [Log(Ω·cm)], and more preferably 10 [Log (Ω·cm)] to 14 [Log(Ω·cm)]. If the volume resistivity is less than 10 [Log(Ω·cm)], carrier adhesion may easily occur in a non-image portion, and if it is more than 16 [Log (Ω·cm)], the edge effect may degrade to an unacceptable level.

Figure 5:
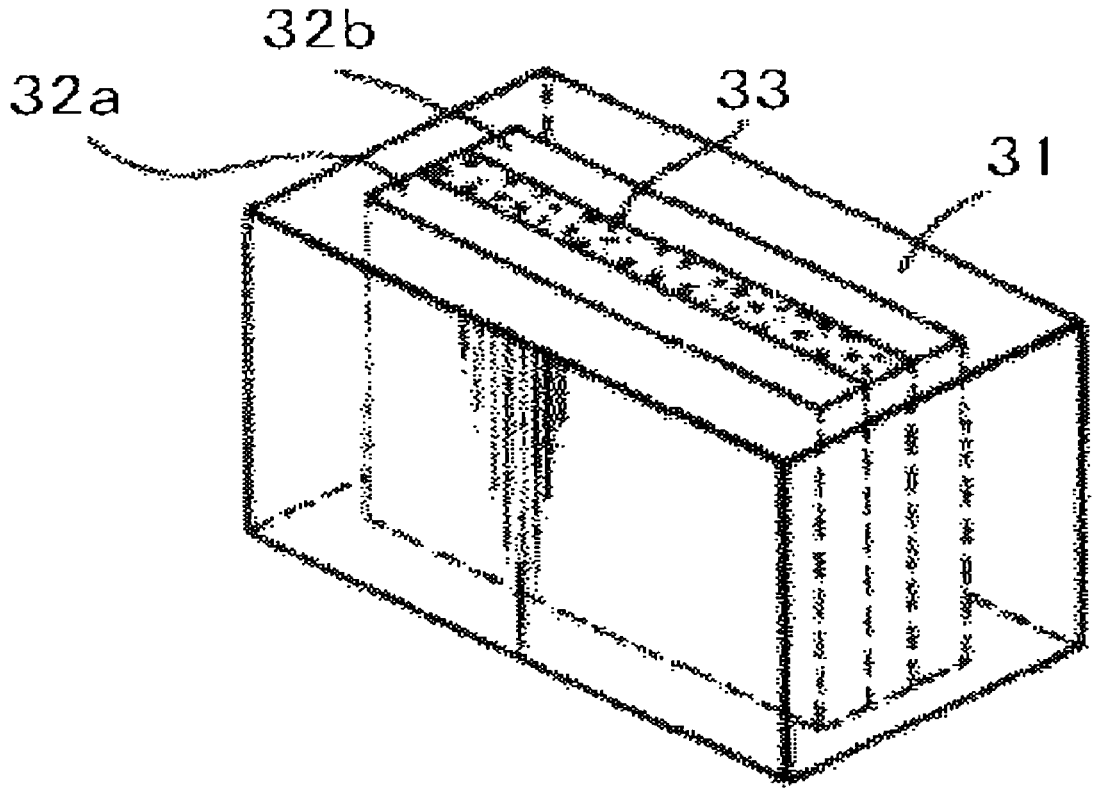
FIG. 5 is a schematic view of a carrier resistance measuring device.

For the volume resistivity, as shown in FIG. 5, a carrier 33 is filled in a cell 31 of a fluorine resin container that houses electrodes 32*a* and 32*b* each having a surface area of 2 cm×4 cm arranged with a distance between the electrodes of 2 mm, and a tapping operation is carried out at a tapping speed of 30 times/min for one minute using a tapping machine PTM-1, manufactured by SANKYO PIO-TECH. CO., Ltd. A direct current voltage of 1000V is applied between both electrodes, a direct current resistance is measured by High Resistance Meter 4329A (4329A+LJK 5HVLVWDQFH OHWHU: manufactured by Yokogawa Hewlett Packard Co., Ltd) to determine electrical resistivity R Ω·cm, and LogR is calculated.

If below the measurable lower limit of the high-resistance meter, the volume resistivity value cannot be substantially obtained, and the high-resistance meter is regarded as being broken down.

Volume average particle diameter of the carrier is preferably 20 μm to 65 μm, and more preferably 20 μm to 55 μm, and still preferably 20 μm to 40 μm. If the volume average particle diameter is less than 20 μm, since uniformity of the particles decreases and a technology for making full use thereof has not yet been established on the machine side, a problem such as carrier adhesion occurs, which is not preferable. On the other hand, if the volume average particle diameter is more than 65 μm, fine images may not be obtained due to an inferior reproducibility in image details.

The volume average particle diameter of the carrier can be measured using an SRA type of Microtrac Particle-Size Analyzer (manufactured by NIKKISO CO., LTD.). One with a range setting of 0.7 μm or more and 125 μm or less is used.

Moreover, methanol is used for a dispersion liquid, the refractive index of which is set to 1.33, and the refractive index of the carrier and core material is set to 2.42.

In a system that requires high image quality such as color images, a resistance adjustment of the carrier is dispensable, and a carrier with an extremely high resistance causes image defects such as carrier adhesion (edge carrier adhesion) to a non-image portion and white voids.

In the case of resistance adjustment of the carrier, a resistance adjustment has been conventionally carried out by adding, as a resistance adjuster, conductive fine particles such as carbon black, titanium oxide, zinc oxide, indium oxide, fine particles surface-coated with indium oxide into the carrier coating layer. However, the conductive fine particles are mixed in the toner due to scraping of the coating layer, and color smear is caused in color images unless the conductive fine particles are colorless or white. Although carbon black, indium oxide, etc., in a small amount have an effect to lower carrier resistance, these cannot be used because of the problem of color smear.

Moreover, zinc oxide and indium oxide are white but cannot, in a small amount, provide such an effect to lower resistance as by carbon black, and must be added in a large amount into the coating layer, which is not preferable in terms of cost since these are very expensive materials.

Therefore, it is effective in a resistance adjustment that a carrier having a coating layer on the core surface contains, in the coating layer, conductive fine particles each having a conductive coating layer including oxide indium provided on the surface of base particles. Powder resistivity of the conductive fine particles is preferably 1.0Ω·cm to 200Ω·cm, more preferably 1.0Ω·cm to 100Ω·cm, still preferably 1.0 Ω·cm to 15Ω·cm, and particularly preferably 1.0Ω·cm to 5.0Ω·cm. Containing conductive fine particles having such powder resistivity allows effectively conducting a resistance adjustment. This is considered to be because resistance adjusting effects are exhibited by making conductive fine particles with indium oxide being a low-resistance material provided on the surface of base particles be contained in the carrier coating layer.

If the powder resistivity is less than 1.0Ω·cm, the ability to lower resistance of the conductive fine particles is so high that resistance considerably fluctuates due to a slight fluctuation in the amount of conductive fine particles, and it can be difficult to adjust the carrier resistance to an appropriate value. Moreover, since only a small amount of conductive fine particles can be added, the particles occupy a smaller proportion of the carrier particle surface than the binder resin does, the effect to relieve contact involving a strong impact on the binder resin is small, and thus it is also often the case that a sufficient durability cannot be obtained, which is not preferable.

On the other hand, if the powder resistivity is more than 200 Ω·cm, the ability to lower resistance of the conductive fine particles is low, so that it is difficult to lower the carrier resistance to an appropriate value.

Now, a method for measuring the powder resistivity will be described (see FIG. 1).

Five grams of a sample is measured out with an even balance, and while a steel electrode 22*a* is applied to the lower portion of a vinyl chloride tube 21 having an inner diameter of 1 inch, the sample 23 is charged in the vinyl chloride tube 21. Next, a steel electrode 22*b* is also applied to the upper portion of the vinyl chloride tube 21. Two-millimeter-thick Teflon (registered trademark) sheets 24*a*, 24*b* are laid on and under the electrodes 22*a*, 22*b*, respectively, and weighting of a hydraulic gauge scale of 10 kg/cm$^2$ is applied by a hydraulic press. An LCR meter 25 (4261A, manufactured by Yokogawa Hewlett Packard Co., Ltd or a meter with an equal or surpassing performance) is connected under pressurization at 10 kg/cm$^2$. A resistance r(Ω) immediately after the connection is read and the overall length L(cm) is measured by a caliper to calculate powder resistivity (Ω·cm). The calculation formula is as shown in the following.

$$\text{Powder resistivity}(\Omega\cdot\text{cm})=\{(2.54/2)2\times\pi\}\times r/(L-11.35)$$

In the above formula, r denotes a resistance immediately after the connection, L denotes an overall length when the sample has been filled, and 11.35 is the overall length when the sample has not been filled.

Moreover, the content by percentage of the conductive fine particles in the present invention is expressed by the following formula:

Content(% by mass) of conductive fine particles= [amount of conductive fine particles/(total amount of conductive fine particles+total solid content of coating resin)]×100

Here, "total sold content of coating resin" means the total amount of binder resin in the resin coating film (the coating layer).

The conductive fine particles show a more remarkable improvement effect by being provided with a conductive coating film layer made from, at least, tin dioxide and indium oxide on the surface of base particles. Coating the surface of base particles with the indium oxide in the form of a tin oxide hydrate and an indium oxide hydrate allows firmly fixedly adhering to the base particles, and it becomes possible to obtain long-life conductive fine particles.

The conductive fine particles show a more remarkable improvement effect by using a structure in which a conductive coating film layer composed of a tin dioxide layer and an indium oxide layer including tin dioxide provided on the tin dioxide layer is provided on the surface of the base particles.

If a conductive coating film including indium oxide is formed directly on the surface of base particles, it becomes difficult to exhibit, as targeted, a resistance adjusting effect of conductive fine particles to be obtained since it is difficult to provide the coating film uniformly and stably, and furthermore, this may also result in a short service life.

Meanwhile, first providing a tin dioxide layer as a lower layer on the surface of base particles and providing thereon a layer of indium oxide including tin dioxide that is a conductive layer allows fixing the conductive layer being an upper layer uniformly and firmly, and thus it becomes possible to obtain long-life conductive fine particles that exhibit a resistance adjusting effect as targeted. The improvement effect is therefore considered to be remarkable.

Here, the conductive coating film layer is preferably formed by, for example, a method for coating the surface of base particles with a hydrate of tin dioxide, then coating the surface with an oxide indium hydrate including a hydrate of tin dioxide, and applying thereto a heating treatment in an inert gas atmosphere to 350° C. to 750° C., however, the method is not always limited thereto.

Furthermore, the improvement effect is remarkable if the base of the conductive fine particles uses any of the inorganic white pigments such as aluminum oxide, titanium dioxide, zinc oxide, silicon dioxide, barium sulfate, and zirconium oxide alone or in combination of two or more. This is considered to be because compatibility with a conductive treatment of the particle surface is excellent, and an effect of the conductive treatment can be satisfactorily exhibited. The present invention is by no means limited to the above-mentioned particles, and any other particles that exhibit a satisfactory effect can also be used.

The following is an aspect of a more detailed method for manufacturing conductive fine particles suited to the present invention.

In a method for manufacturing conductive film particles in which a conductive coating film layer made from, at least, tin dioxide and indium oxide is provided on the surface of base particles, a coating film of a hydrate of indium oxide including tin dioxide is first formed on the surface of base particles. This method includes various methods, but more preferable is, for example, a method in which a mixed solution of a tin salt and an indium salt and an alkali are added separately and in parallel to an aqueous suspension of an inorganic white pigment (base particles) to form a coating film. It is more preferable, at this time, to warm the aqueous suspension to 50° C. to 100° C. Moreover, the pH when adding the mixed solution and alkali in parallel is 2 to 9, and it is important to maintain the pH at, preferably, 2 to 5 or 6 to 9, which allows depositing hydration products of tin and indium uniformly.

Examples of tin raw materials that can be used include tin chloride, tin sulfate, and tin nitrate. Examples of indium raw materials that can be used include indium chloride and indium sulfate.

The amount of tin dioxide to be added is preferably 0.1% by mass to 20% by mass, and more preferably, 2.5% by mass to 15% by mass, as $SnO_2$, on the basis of $In_2O_3$. A desired conductivity cannot be attained if the amount to be added is too small or too large.

The amount of indium oxide to be treated is preferably 5 parts by mass to 200 parts by mass, and more preferably, 8 parts by mass to 150 parts by mass, as $In_2O_3$, on the basis of 100 parts by mass of the inorganic pigment of the base. The desired conductivity cannot be attained if the amount to be treated is too small, and the conductivity is improved if the amount is increased. However, if the amount is too large, there is almost no improvement in conductivity, and the cost is increased, which is also not preferable in terms of cost.

In a method for manufacturing conductive fine particles in which a conductive coating film layer made from a tin dioxide layer and an indium oxide layer including tin dioxide provided on the tin dioxide layer is provided on the surface of base particles, a coating film of a hydrate of tin dioxide is first formed as a lower layer. This method includes various methods, but there is, for example, a method in which a tin salt or a stannate is added to an aqueous suspension of an inorganic white pigment, and then an alkali or an acid is added, and a method in which a solution of a tin salt or a stannate and an alkali or an acid are added separately and in parallel to an aqueous suspension of an inorganic white pigment to perform a coating treatment. The latter method of parallel addition is more suited to uniformly coating the surface of inorganic white pigment particles with a hydrated tin oxide, and it is preferable, at this time, to warm and keep the aqueous suspension at 50° C. to 100° C. Moreover, the pH when adding the tin salt or stannate and the alkali or acid in parallel is 2 to 9. Since the isoelectric point of a tin dioxide hydrate is a pH of 5.5, it is important to maintain the pH at, preferably, 2 to 5 or 6 to 9, which allows uniformly depositing a hydration product of tin on the surface of inorganic white pigment particles.

Examples of tin salts that can be used include tin chloride, tin sulfate, and tin nitrate. Examples of stannates that can be used include sodium stannate and potassium stannate.

Examples of alkalis that can be used include sodium hydroxide, potassium hydroxide, sodium carbonate, potassium carbonate, ammonium carbonate, aqueous ammonia, and ammonia gas, while examples of acids include hydrochloric acid, sulfuric acid, nitric acid, and acetic acid.

The coating amount of tin dioxide hydrate is preferably 0.5% by mass to 50% by mass, and more preferably, 1.5% by mass to 40% by mass, as $SnO_2$, on the basis of the inorganic white pigment of the base. If the coating amount is too small, the indium oxide hydrate including tin oxide to be coated thereon results in a nonuniform coating state, and moreover, the volume resistivity of the powder rises under the influence of the inorganic pigment of the base. If the coating amount is too large, a lager amount of tin oxide hydrate does not closely adhere to the surface of inorganic white pigment particles of the base, and the coating tends to become nonuniform.

A method for, next, forming a coating of indium oxide hydrate including tin dioxide as an upper layer also includes various methods, but, for not dissolving the coating film of tin dioxide hydrate previously coated, more preferable is a method in which a mixed solution of a tin salt and an indium salt and an alkali are added separately and in parallel to form a coating film. It is more preferable, at this time, to warm the aqueous suspension to 50° C. to 100° C. Moreover, the pH when adding the mixed solution and alkali in parallel is preferably 2 to 9, and it is import to maintain the pH at, preferably, 2 to 5 or 6 to 9, which allows depositing hydration products of tin and indium uniformly.

Examples of tin raw materials that can be used include tin chloride, tin sulfate, and tin nitrate. Examples of indium raw materials that can be used include indium chloride and indium sulfate.

The amount of tin dioxide to be added is preferably 0.1% by mass to 20% by mass, and more preferably, 2.5% by mass to 15% by mass, as $SnO_2$, on the basis of $In_2O_3$. A desired conductivity cannot be attained if the amount to be added is too small or too large.

The amount of indium oxide to be treated is preferably 5 parts by mass to 200 parts by mass, and more preferably, 8 parts by mass to 150 parts by mass, as $In_2O_3$, on the basis of 100 parts by mass of the inorganic pigment of the base. A desired conductivity cannot be attained if the amount to be treated is too small, and if the amount is too large, there is almost no improvement in conductivity, and the cost is increased, which is also not preferable in terms of cost.

As used in the present invention, "conductivity" means having a value of 1Ω·cm to 500Ω·cm as the value of volume resistivity of the powder. As shown in the examples to be described later, the present invention allows obtaining a white conductive powder with a very excellent conductivity of 100Ω·cm or less to that of an antimony-containing product, and possibly, 10Ω·cm or less.

The heating treatment is preferably carried out at 350° C. to 750° C. in a nonoxidizing atmosphere, where the volume resistivity of the powder can be reduced by two or three digits from that applied with a heating treatment in the air.

An inert gas can be used to create the nonoxidizing atmosphere. Examples of inert gases that can be used include nitrogen, helium, argon, and carbon dioxide. For industrial purposes, it is advantageous in terms of cost to carry out a heating treatment while blowing in nitrogen gas, whereby a product with stable properties can be obtained.

The temperature for heating is preferably 350° C. to 750° C., and more preferably 400° C. to 700° C. A desired conductivity is hard to attain in either case that the temperature is higher or lower than this range. The heating time is approximately 15 minutes to 4 hours, and preferably, approximately 1 hour to 2 hours since there is no heating effect if it is too short, and no further effect can be expected if it is too long.

The improvement effect is remarkable if the binder resin in the coating layer is a silicone resin. This is because a silicone resin has a low surface energy and is thus difficult to cause spent of toner components, so that an effect that accumulation of spent components to cause film scraping is unlikely to progress can be obtained.

The silicone resin means all generally-known silicone resins, which include straight silicone resins composed only of organosiloxane bonds, and silicone resins modified with an alkyd resin, polyester resin, epoxy resin, acrylic resin, urethane resin, or the like, but are not limited thereto.

Examples of commercially available straight silicone resins include KR271, KR255, and KR152 manufactured by Shin-Etsu Chemical Co., Ltd., and SR2400, SR2406, and SR2410 manufactured by Dow Corning Toray Silicone Co., Ltd. In this case, a silicone resin can be used by itself, but it is also possible to use another component for a cross-linking reaction, a charge amount adjusting component, or the like at the same time. Furthermore, examples of modified silicone resins include KR206 (alkyd modified), KR5208 (acrylic modified), ES 1001N (epoxy modified), and KR305 (urethane modified) made by Shin-Etsu Chemical Co., Ltd., and SR2115 (epoxy modified) and SR2110 (alkyd modified) manufactured by Dow Corning Toray Silicone Co., Ltd.

Adding a catalyst when using a silicone resin allows improving carrier coating film strength, drying properties after coating, yield, etc.

Examples of catalysts that can be used include organic tins such as dibutyltin, dimethyltin, and dioctyltin, inorganic tins such as tin decanoate, tin octylate, and tin stearate, titanium compounds such as titanium chelate and titanium alkoxide, zirconium compounds such as zirconium alkoxide, zirconium chelete, isocyanate compounds, and aluminum compounds.

The improvement effect is remarkable if at least the binder resin uses an acrylic resin in combination. This is because, since acrylic resins exhibit strong adhesion and low brittleness and thus have very excellent abrasion resistance, and therefore, degradation such as scraping of the coating layer or film peeling is unlikely to occur, it is possible to stably maintain the coating layer, and particles contained in the coating layer such as conductive fine particles can be firmly sustained by the strong adhesion. In particular, a powerful effect can be exhibited to sustain particles having a particle diameter larger than the thickness of the coating layer. The acrylic resin in the present specification means any resins having an acrylic component and is not particularly limited.

The acrylic resin can be used by itself, but it is also possible to use in combination at least one component for a cross-linking reaction. Examples of other components for a cross-linking reaction herein include amino resins and acidic catalysts, but are not limited thereto. The amino resins herein mean guanamine, melamine resins, etc., but are not limited thereto.

Also, as the acidic catalysts, any acidic catalysts having a catalytic effect can be used.

Examples thereof are ones having a reactive group of a fully alkylated type, a methylol group type, an imino group, a methylol/imino group, etc., but are not limited thereto. The acrylic resins exhibit strong adhesion and low brittleness and thus have very excellent abrasion resistance, on the other hand, have a higher surface energy, therefore, in combination with a toner that is likely to cause spent, there may arise such an inconvenience as a decrease in charge amount due to spent (accumulation) of toner components. Such a problem can be solved by using in combination a silicone resin capable of providing an effect that spent of toner components hardly occurs due to lower surface energy and accumulation of spent components to cause film scraping is unlikely to progress.

However, the silicone resins exhibit weak adhesion and high brittleness and thus also have a drawback of being inferior in abrasion resistance, and it is therefore important to thoroughly balance the properties of these two types of resins, thereby making it possible to obtain a coating layer hardly causing spent and having abrasion resistance.

The magnetic carrier has a magnetic moment of 40 ($Am^2/kg$) or more and 90 ($Am^2/kg$) or less at 1000 ($10^3/4\pi \cdot A/m$). In this range, an improvement effect of reproducibility is excellent, and fine images can be obtained.

The magnetic moment can be measured as follows.

A B-H tracer (BHU-60, manufactured by Riken Denshi Co., Ltd.) is used, 1.0 g of core particles are filled in a cylindrical cell (inner diameter: 7 mm, height: 10 mm), and the cell is set in the tracer. A magnetic field is gradually increased and changed to 3000 oersteds, and then gradually decreased to zero, and then a magnetic field in the opposite direction is gradually increased to 3000 oersteds. Further, the magnetic field is gradually decreased to zero, and then a magnetic field in the same direction as the first direction is applied. A B-H curve is thus illustrated, and a magnetic moment at 1000 oersteds is determined from the illustration.

[Image Forming Apparatus and Process Cartridge]

An image forming apparatus of the present invention includes at least: a latent electrostatic image bearing member, a latent electrostatic image forming unit configured to form a latent electrostatic image on the latent electrostatic image bearing member; a developing unit configured to develop the latent electrostatic image using a toner to form a visible image, a transferring unit configured to transfer the visible image onto a recording medium, and a fixing unit configured to fix a transfer image transferred onto the recording medium. In the image forming apparatus, the developing unit is the developing device of the present invention.

A process cartridge of the present invention includes at least a latent electrostatic image bearing member and a developing unit configured to develop a latent electrostatic image formed on the latent electrostatic image bearing member using a toner to form a visible image, and is detachably mounted to an image forming apparatus body. In the process cartridge, the developing unit is the developing device of the present invention.

Figure 2:
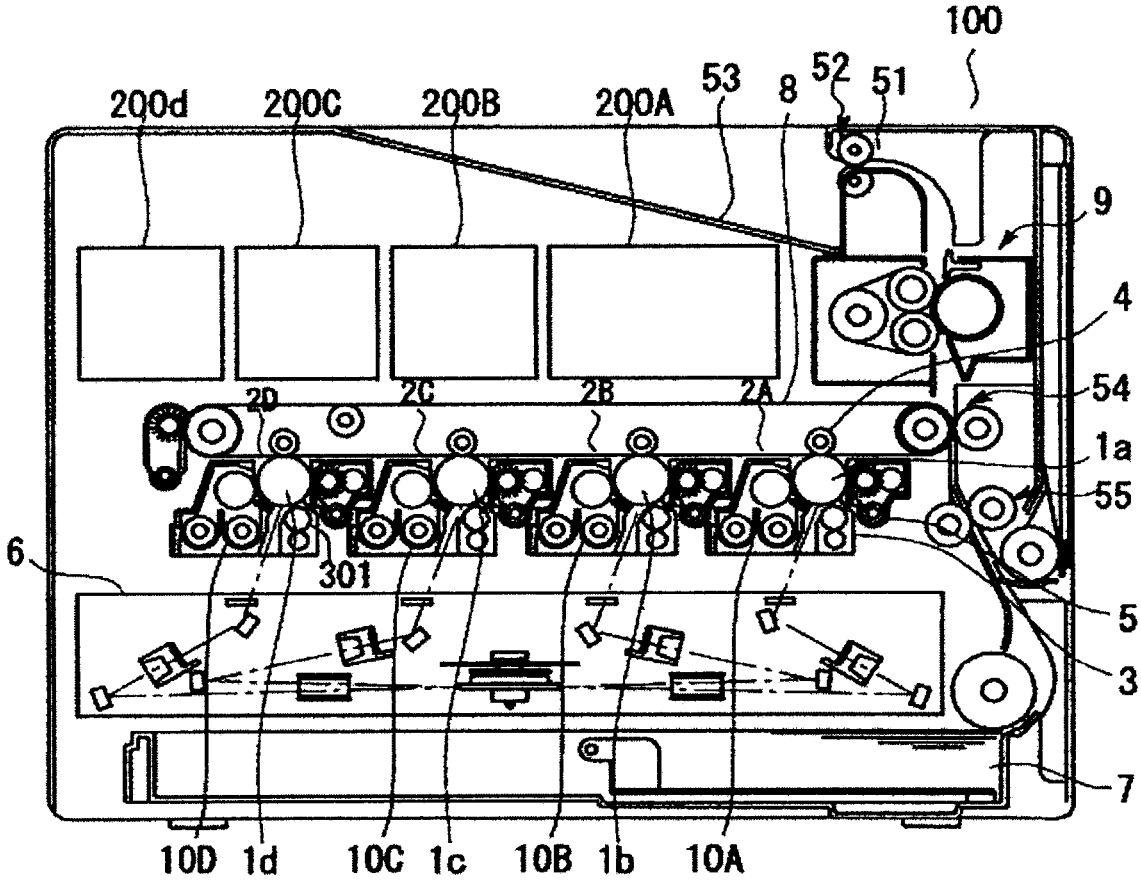
FIG. 2 is a view showing an example of an image forming apparatus of the present invention having a process cartridge.

Here, FIG. 2 shows an image forming apparatus containing a process cartridge including a developer of the present invention.

In FIG. 2, reference numerals 1*a*, 1*b*, 1*c*, id each denote a photoconductor drum, reference numerals 2A, 2B, 2C, 2D each denote a developing device, reference numeral 3 denotes a charging device, reference numeral 4 denotes a primary transfer roller, reference numeral 5 denotes a waste toner collecting mechanism, reference numeral 6 denotes an optical system device, reference numeral 7 denotes a paper feed tray, reference numeral 8 denotes an intermediate transfer belt, reference numeral 9 denotes a fixing device, reference numerals 10A, 10B, 10C, 10D each denote a screw, reference numeral 51 denotes a paper discharge port, reference numeral 52 denotes a paper discharge roller, reference numeral 53 denotes a paper discharge tray, reference numeral 54 denotes a secondary transfer roller, reference numeral 55 denotes a conveyance roller, reference numeral 100 denotes an apparatus body, reference numerals 200A, 200B, 200C, 200D each denote a toner cartridge, and reference numeral 301 denotes a charging roller.

Figure 3:
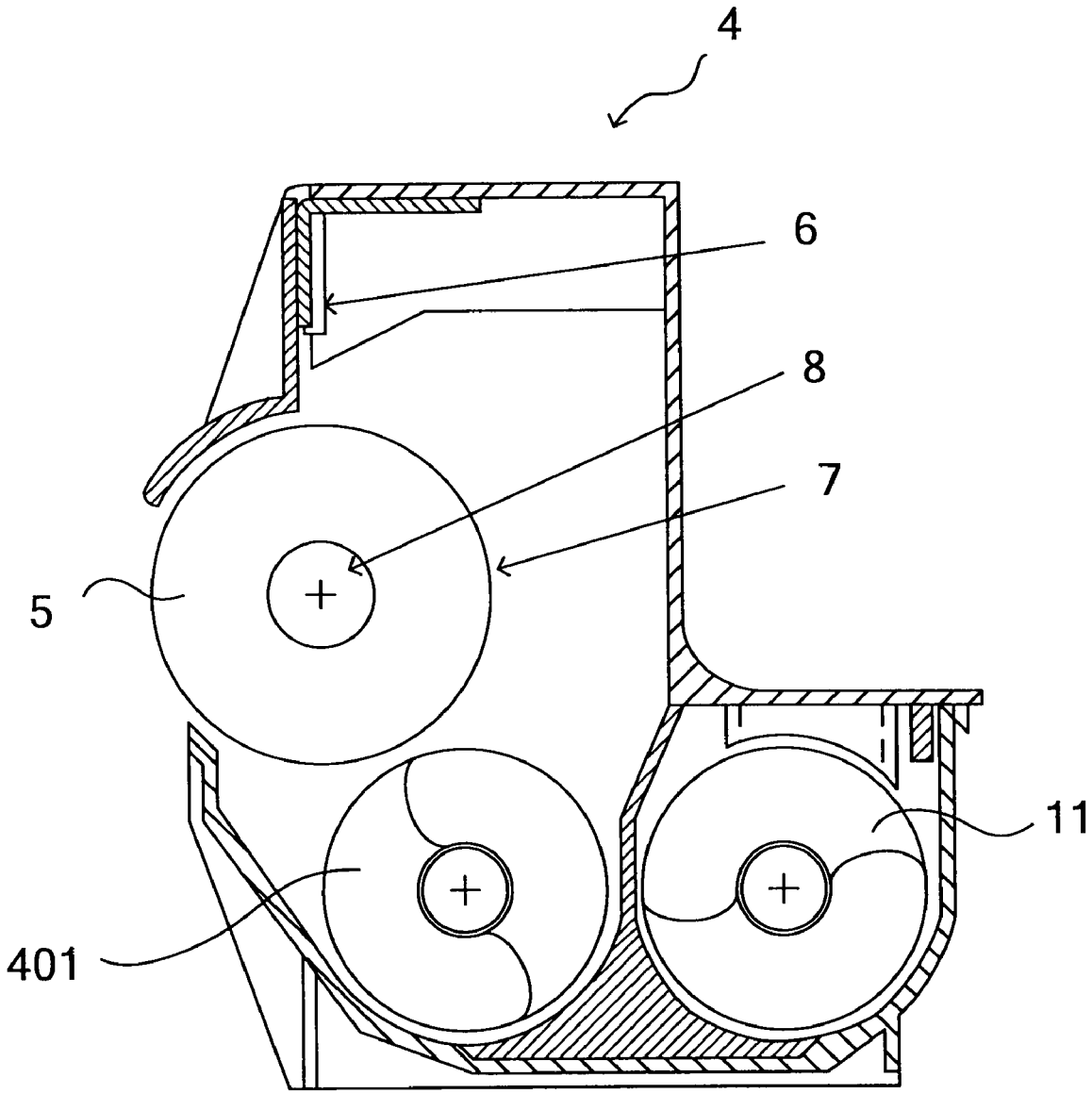
FIG. 3 is a view showing an example of an image forming apparatus of the present invention.

FIG. 3 shows a schematic configuration of a developing device. In FIG. 3, reference numeral 4 denotes the entire developing device, reference numeral 5 denotes a developing roller, reference numeral 6 denotes a developer amount control member, reference numeral 7 denotes a developer bearing member including a nonmagnetic developing sleeve, reference numeral 8 denotes a magnetic field generating unit, reference numeral 11 denotes a conveying screw, and reference numeral 401 denotes a feeding screw.

Figure 4:
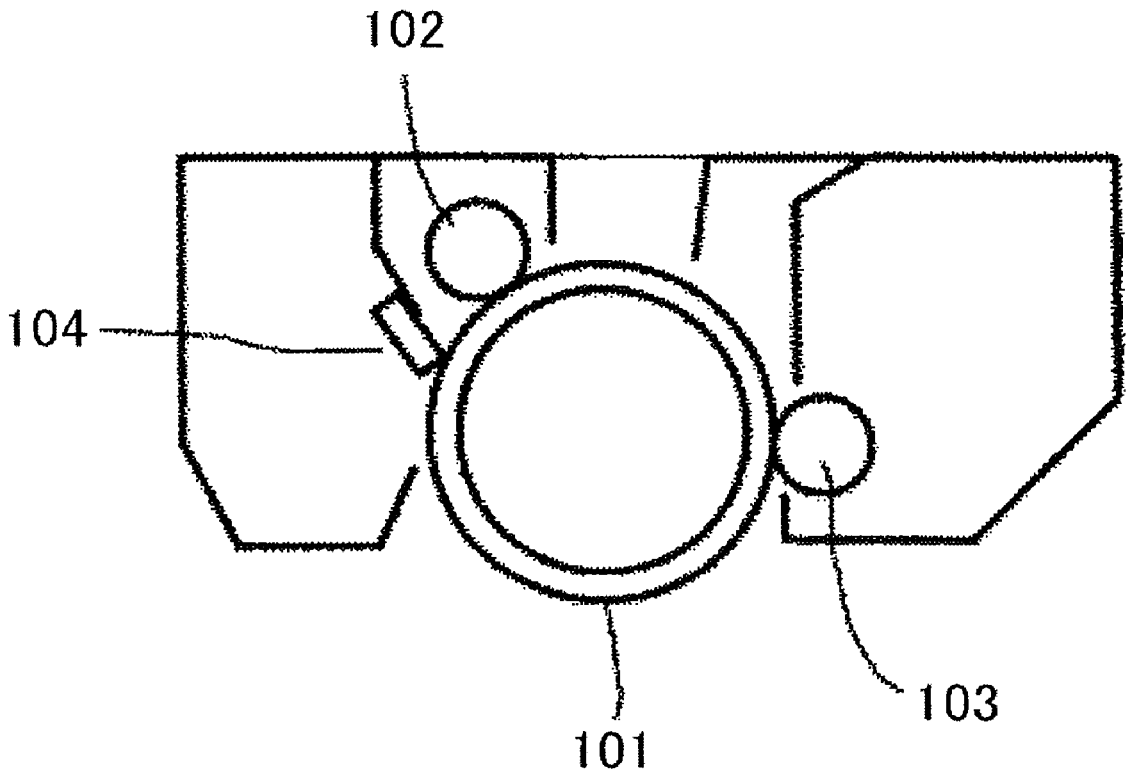
FIG. 4 is a view showing an example of a process cartridge of the present invention.

FIG. 4 shows the entire process cartridge, which includes a photoconductor 101, a charging unit 102, a developing unit 103, and a cleaning unit 104.

In the present invention, of the components including a photoconductor, a charging unit, a developing unit, and a cleaning unit described above, the developing unit and another or other units are combined integrally as a process cartridge, and the process cartridge is structured to be attachable to and detachable from the image forming apparatus body such as a copier or a printer.

For an image forming apparatus mounted with a process cartridge having a developing unit using a developer of the present invention, a photoconductor is driven to rotate at a predetermined peripheral speed.

The photoconductor is, in the course of rotation, uniformly charged with a predetermined positive or negative potential at its circumferential surface by the charging unit, and then receives an image exposure light from an image exposure unit of a slit exposure, a laser beam scanning exposure, or the like, latent electrostatic images are thus sequentially formed on the circumferential surface of the photoconductor, the formed latent electrostatic images are next toner-developed by the developing unit, and the toner images are sequentially transferred, by a transfer unit, onto a transfer material fed from a paper feed section between the photoconductor and the transfer unit in synchronization with a rotation of the photoconductor.

The transfer material transferred with images is separated from the photoconductor surface and introduced into the image fixing unit for image fixation, and is printed out as a copy to outside the apparatus. The photoconductor surface after an image transfer is provided as a clean surface through removal of an untransferred toner by a cleaning unit, further discharged, and then repeatedly used for image formation.

EXAMPLES

Hereinafter, the present invention will be described in greater detail with reference to examples and comparative examples, however, the present invention is by no means limited to these. All percentages and parts are by mass unless indicated otherwise.

Example 1

| [Carrier Coating Layer] | |
|---|---|
| Silicone resin solution [Solid content 23% (SR2410: manufactured by Dow Corning Toray Silicone Co., Ltd.)] | 432.2 parts |
| Aminosilane [Solid content 100% (SH6020: manufactured by Dow Corning Toray Silicone Co., Ltd.)] | 0.66 parts |
| Conductive inorganic fine particles A: average primary article diameter: 0.43 μm (true specific gravity: 4.6) | 145 parts |
| Toluene | 300 parts |

These components were dispersed by a homomixer for 10 minutes to obtain a silicone coating layer forming solution.

5000 parts of a calcined ferrite powder (true specific gravity 5.5) having an average primary particle diameter of 35 μm was used as a core material, and the coating layer forming solution was applied to the core surface so as to be a thickness of 0.35 μm by SPIRA COTA (manufactured by OKADA SEIKO CO., LTD.), in which the temperature was 40° C., and dried. The obtained carrier was calcined by being allowed to stand at 200° C. for 1 hour in an electric furnace. After cooling, the ferrite powder bulk was crushed using a sieve with openings of 63 μm to obtain [carrier 1] where D/h: 1.23, volume resistivity: 12.9 [Log (Ω·cm)], and magnetization: 68 $Am^2/kg$. At this time, the conductive fine particles contained in the coating layer had the coverage of 71% to the core material.

Also, particle powder resistivity of the carrier 1 was measured using a carrier resistance measuring device shown in FIG. 5.

[Evaluation of Carrier]

For a measurement of the average primary particle diameter of the core material, an SRA type of Microtrac Particle-Size Analyzer (manufactured by NIKKISO CO., LTD.) was used, with a range setting of 0.7 μm or more and 125 μm or less.

For a measurement of the coating layer thickness, because a coating layer that coats the carrier surface can be observed by observing a carrier section through a transmission electron microscope, an average thickness value thereof was determined as the thickness.

Magnetization was measured, using VSM-P7-15 manufactured by Toei Industry Co., Ltd., by the following method. That is, 0.15 g of a sample was weighted, the sample was filled in a cell with an inner diameter of 2.4 mm and a height of 8.5 mm, and a value of magnetization was measured under a magnetic field of 1000 oersteds (Oe).

[Developing Sleeve]

Electromagnetic blasting was performed, and a developing sleeve having a surface roughness Ra of 1.2 μm was used.

Figure 6:
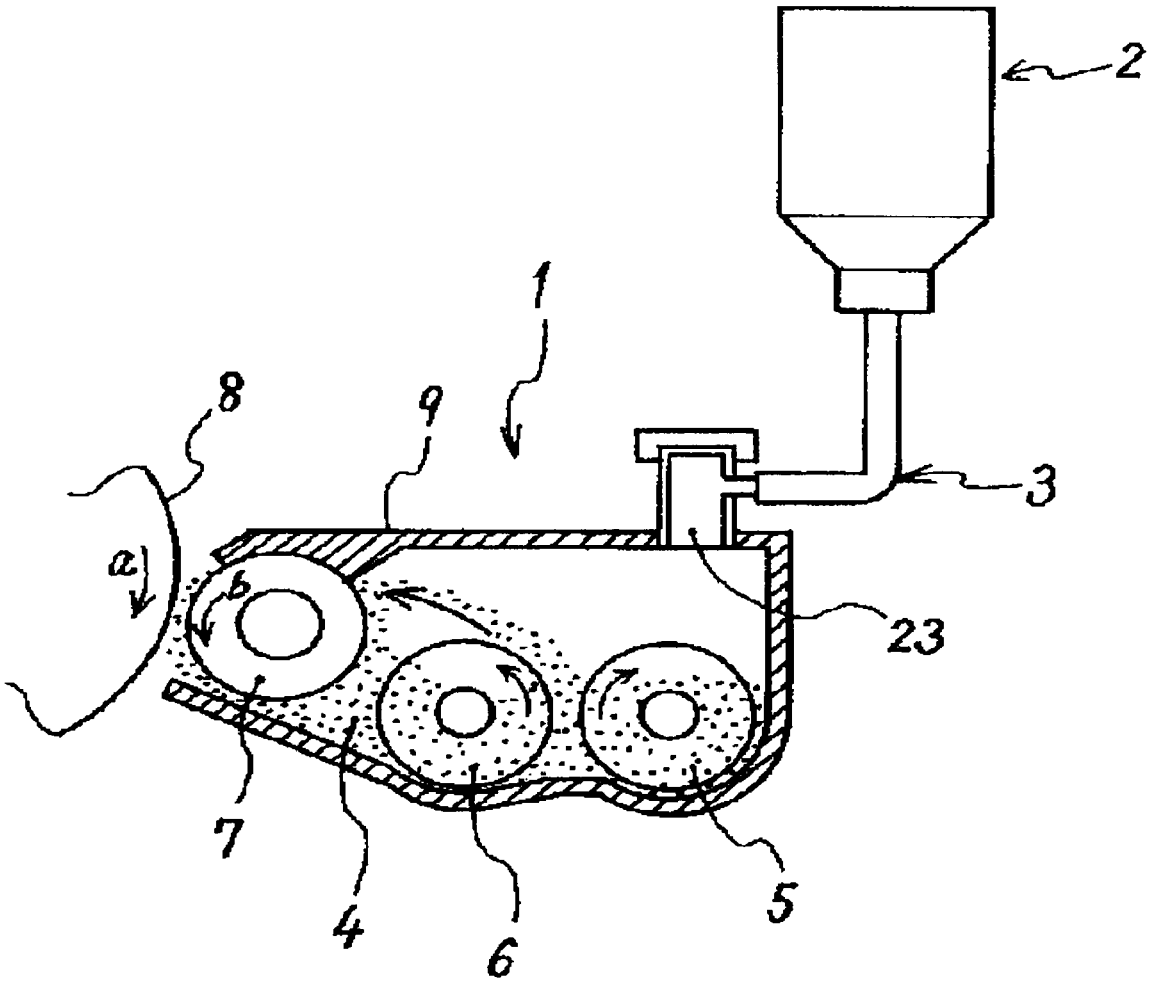
FIG. 6 is a schematic view of a developing device.

FIG. 6 shows an example of the developing device. The developing device 1 includes a nonmagnetic developing sleeve 7 serving as a developer bearing member disposed lateral to a photoconductor 8 and bearing a two-component developer containing toner and magnetic carrier on its surface. Here, the photoconductor 8 rotates in the direction of arrow a. The developing sleeve 7 is attached so as to be partially exposed from an opening portion formed at the photoconductor 8 side of a developing casing, and rotates in the direction of arrow b in the figure. Moreover, in the developing sleeve 7, fixedly arranged is a magnet roller, not shown, composed of stationary magnets serving as a magnetic field generating unit. The developing device 1 also includes a doctor 9 serving as a developer amount control member formed of a rigid body for controlling the amount of the developer to be borne on the development sleeve 7. With respect to the doctor 9, at the upstream side in the rotating direction of the development sleeve 7, a developer housing portion 4 for housing the developer is formed, and first and second stirring screws 5 and 6 for stirring and mixing the developer in the developer housing portion 4 are provided. A toner replenishing port 23 arranged above the developer housing portion 4, a toner hopper 2 filled with toner for replenishment of the developer housing portion 4, and a toner backflow unit 3 that connects the toner replenishing port 23 with the toner hopper 2.

[Toner 1]

(Synthesis of Toner Binder)

724 parts of an ethylene oxide 2-mol adduct of bisphenol A, 276 parts of isophthalic acid, 2 parts of dibutyltin oxide were charged in a reaction tank equipped with a cooling tube, a stirrer, and a nitrogen introduction tube, and the mixture was reacted under normal pressure at 230° C. for 8 hours, and further reacted for 5 hours under a reduced pressure of 10 mmHg to 15 mmHg, and then cooled to 160° C. 32 parts of phthalic anhydride was added thereto, and the mixture was reacted for 2 hours.

The mixture was then cooled to 80° C., and allowed to react for 2 hours with 188 parts of isophorone diisocyanate in ethyl acetate to obtain an isocyanate-containing prepolymer (1).

267 parts of the prepolymer (1) and 14 parts of isophoronediamine were then reacted at 50° C. for 2 hours to obtain a urea-modified polyester having a weight average molecular weight of 64,000.

In the same manner as above, 724 parts of an ethylene oxide 2-mol adduct of bisphenol A and 276 parts of terephthalic acid were subjected to condensation under normal pressure at 230° C. for 8 hours. The mixture was then reacted for 5 hours under a reduced pressure of 10 mmHg to 15 mmHg to obtain an unmodified polyester (a) having a peak molecular weight of 5,000.

200 parts of the urea-modified polyester (1) and 800 parts of the unmodified polyester (a) were dissolved and mixed in 2000 parts of a mixed solvent of ethyl acetate/MEK (1/1) to obtain an ethyl acetate/MEK (1/1) solution of a toner binder (1). A part of the solution was dried under reduced pressure to isolate the toner binder (1). The toner binder (1) had a glass transition temperature (Tg) of 62° C.

(Preparation of Toner)

240 parts of the ethyl acetate/MEK (1/1) solution of the toner binder (1), 20 parts of pentaerythritol tetrabehenate (melting point 81° C., melt viscosity 25 cps), and 4 parts of a pure pigment of C.I. Pigment Yellow 154 were charged in a beaker, and the mixture was stirred at 60° C. at 12,000 rpm using a TK-type homomixer so as to be uniformly dissolved and dispersed, thereby obtaining a toner material solution.

Next, 706 parts of ion exchanged water, 294 parts of a 10% suspension of hydroxyapatite (SUPATITE 10, manufactured by Nippon Chemical Industrial Co., Ltd.), and 0.2 parts of sodium dodecylbenzenesulfonate were charged in a beaker and uniformly dissolved.

The solution was then heated to 60° C., the above-mentioned toner material solution was added to the solution with stirring at 12,000 rpm by a TK-type homomixer, and the stirring was continued for another ten minutes.

The mixture was then poured into a flask equipped with a stirrer and a thermometer, and heated to 98° C. to remove the solvent. The dispersion slurry was filtered under reduced pressure, and then a filter cake was obtained.

(Washing, Drying, and Fluorine Treatment)

1: To the filter cake, 100 parts of ion exchanged water was added and mixed by a TK homomixer (for 10 minutes at a rate of 12,000 rpm), and then the mixture was filtered.

2: To the filter cake obtained in the above 1, 100 parts of a 10% sodium hydroxide aqueous solution was added and mixed by a TK homomixer (for 30 minutes at a rate of 12,000 rpm), and then the mixture was filtered under reduced pressure.

3: To the filter cake obtained in the above 2, 100 parts of 10% hydrochloric acid was added and mixed by a TK homomixer (for 10 minutes at a rate of 12,000 rpm), and then the mixture was filtered.

4: An operation of adding 300 parts of ion exchanged water to the filter cake obtained in the above 3 and mixing by a TK homomixer (for 10 minutes at a rate of 12,000 rpm) and then filtering the mixture was conducted two times to obtain a cake-like matter. This was provided as [filter cake 1].

The above-mentioned [filter cake 1] was dried in a circulating air drier at 45° C. for 48 hours. Then, 15 parts of [filter cake 1] was added to 90 parts of water, and therein 0.0005 parts of a fluorine compound expressed by the following general expression was dispersed to adhere to the fluorine compound to the toner particle surface, and then dried in a circulating air drier at 45° C. for 48 hours. Then, the particles were sieved through a mesh with openings of 75 μm to obtain toner base particles. This was provided as [toner base particle 1].

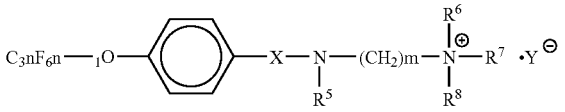

To 100 parts of the obtained [toner base particle 1], 1.5 parts of hydrophobic silica and 0.7 parts of hydrophobized titanium oxide were added as external additives and mixed in a Henschel mixer (2000 rpm×30 seconds, 5 cycles) to obtain a toner. This was provided as "toner 1."

7 parts of the obtained [toner 1] and 93 parts of [carrier 1] were mixed and stirred to prepare a developer having a toner concentration of 7%.

Next, the obtained developer was evaluated for carrier adhesion, image density, and durability (amount of charge decrease, amount of resistance change) as follows. The results are shown in Table 2.

[Carrier Adhesion to Edge Portion]

The developer was set in a modified commercially-available digital full-color printer (imagio Neo C455, manufactured by Ricoh Company, Ltd.), which was adjusted to a charge potential of 740V DC and a developing bias of 600V (background potential was fixed to 140V), the number of carriers adhered to the surface of a photoconductor on which a halftone image formed in dots had been developed was counted in 5 fields of view by observing with a loupe, an average number of adhered carriers per 150 $cm^2$ thereof was determined as the amount of edge carrier adhesion, which was evaluated according to the following criteria:

A: 20 or less, B: 21 to 60, C: 61 to 80, and D: 81 or more, of which A, B, and C were accepted, and D was rejected.

[Carrier Adhesion to Solid Portion]

For the amount of carrier adhesion in a solid portion, the printer was adjusted to a charge potential of 740V DC and a developing bias of 600V (background potential was fixed to 140V), two sheets of entire solid images (A3 size) were output, and the number of white voids in the image was counted, and evaluated according to the following criteria:

A: 5 or less, B: 6 to 10, C: 11 to 20, and D: 21 or more, of which A, B, and C were accepted, and D was rejected.

[Image Density]

After running output of 300,000 sheets of image charts with a 50% image area in a monochrome mode, a solid image was output on a Type 6000 paper manufactured by Ricoh Company, Ltd., and image density was measured by use of an X-Rite (manufactured by X-Rite, Ltd.), and evaluated according to the following criteria:

In the evaluation, an image density of 1.8 or more and less than 2.2 was indicated by A, and 1.4 or more and less than 1.8, by B, and 1.2 or more and less than 1.4, by C, and less than 1.2, by D.

[Durability]

The developer was set in a modified commercially-available digital full-color printer (imagio Neo C455, manufactured by Ricoh Company, Ltd.), and a running evaluation was conducted for 300,000 sheets of image charts with a 50% image area in a monochrome mode. Then, a judgment was made on the basis of the amount of charge decrease of the carrier after the running.

For the amount of resistance decrease, a running evaluation was conducted for 300,000 sheets of image charts with a 0.5% image area in a monochrome mode. Then, a judgment was made on the basis of the amount of resistance decrease of the carrier after the running.

The amount of charge decrease herein means an amount obtained by subtracting a charge amount (Q2) from a charge amount (Q1), the charge amount (Q1) being obtained by humidity-conditioning an initial carrier and a toner in a unsealed system for 30 minutes or more in a room temperature humidity chamber (temperature 23.5° C., humidity 60% RH), filling 6.000 g of the initial carrier of and 0.452 g of the toner in a stainless steel container and sealing the container, then shaking the container by driving YS-LD (shaker, manufactured by YAYOI CO., LTD.) for 5 minutes at a scale of 150 to triboelectrically charge the sample, and measuring the sample by a common blow-off method [TB-200, manufactured by Toshiba Chemical Corporation], and the charge amount (Q2) being obtained by measuring, by the same method as the above, the carrier obtained by removing the toner in the developer after running by the blow-off device, and a target value of which is within 10.0(μC/g).

The amount of resistance decrease herein means an amount obtained by subtracting a resistance value (R2) from a resistance value (R1), the resistance value (R1) being determined from an initial carrier by the above-described resistance measuring method, and the value (R2) being determined by measuring, by the same resistance measuring method as the above, the carrier obtained by removing the toner in the developer after running by the blow-off device, and a target value of which is within 3.0 [Log(Ω·cm)]. Moreover, since the causes of resistance decrease include scraping of the coating film of the carrier, spent of toner components, and desorption of particles in the coating layer of the carrier, reducing these allows curbing the amount of resistance decrease.

Example 2

[Carrier 2] where D/h: 1.1, volume resistivity: 13.1 [Log (Ω·cm)], and magnetization: 68 $Am^2/kg$ was obtained in the same manner as in Example 1, except that the formulation of the coating layer was changed to that of a mixed system of an acrylic resin system and a silicone resin system as described below. At this time, the conductive fine particles contained in the coating layer had the coverage of 71% to the core material.

| | |
|---|---|
| Acrylic resin solution (solid content 50%) | 34.2 parts |
| Guanamine solution (solid content 70%) | 9.7 parts |
| Acidic catalyst (solid content 40%) | 0.19 parts |
| Silicone resin solution [Solid content 20% (SR2410: manufactured by Dow Corning Toray Silicone Co., Ltd.)] | 432.2 parts |
| Aminosilane [Solid content 100% (SH6020: manufactured by Dow Corning Toray Silicone Co., Ltd.)] | 3.42 parts |
| Conductive inorganic fine particles A: average primary particle diameter: 0.43 μm (true specific gravity: 4.6) | 145 parts |

The obtained [carrier 2] and [toner 1] were prepared into a developer by the same method as in Example 1, and the developer was evaluated in the same manner. The results are shown in Table 2.

Comparative Example 1

[Carrier 3] where D/h: 0.8, volume resistivity: 15.8 [Log (Ω·cm)], and magnetization: 66 $Am^2/kg$ was obtained in the same manner as in Example 2, except that 100 parts of conductive inorganic fine particles B (average primary particle diameter: 0.27 μm, true specific gravity: 4.2) were used in place of the conductive inorganic fine particles A in Example 2. At this time, the conductive fine particles contained in the coating layer had the coverage of 85% to the core material.

The obtained [carrier 3] and [toner 1] were prepared into a developer by the same method as in Example 1, and the developer was evaluated in the same manner. The results are shown in Table 2.

Example 3

[Carrier 4] where D/h: 2.0, volume resistivity: 11.6 [Log (Ω·cm)], and magnetization: 68 $Am^2/kg$ was obtained in the same manner as in Example 2, except that the formulation of the coating layer was changed to that of the following ratio of an acrylic resin system and a silicone resin system in Example 2. At this time, the conductive fine particles contained in the coating layer had the coverage of 73% to the core material.

| | |
|---|---|
| Acrylic resin solution (solid content 50%) | 21.5 parts |
| Guanamine solution (solid content 70%) | 6.1 parts |
| Acidic catalyst (solid content 40%) | 0.12 parts |
| Silicone resin solution [Solid content 20% (SR2410: manufactured by Dow Corning Toray Silicone Co., Ltd.)] | 271.7 parts |
| Aminosilane [Solid content 100% (SH6020: manufactured by Dow Corning Toray Silicone Co., Ltd.)] | 2.15 parts |
| Conductive inorganic fine particles A: average primary particle diameter: 0.43 μm (true specific gravity: 4.6) | 150 parts |

The obtained [carrier 4] and [toner 1] were prepared into a developer by the same method as in Example 1, and the developer was evaluated in the same manner. The results are shown in Table 2.

Example 4

[Carrier 5] where D/h: 1.1 and volume resistivity: 9.5 [Log (Ω·cm)] was obtained in the same manner as in Example 2, except that the conductive inorganic fine particles A were increased from 145 parts to 210 parts in Example 2. The fine particles contained in the coating layer had the coverage of 102% to the core material.

The obtained [toner 1] and [carrier 5] were prepared into a developer by the same method as in Example 1, and the developer was evaluated in the same manner. The results are shown in Table 2.

Example 5

[Carrier 6] where D/h: 1.6, volume resistivity: 12.4 [Log (Ω·cm)], and magnetization: 68 $Am^2/kg$ was obtained in the same manner as in Example 2, except that 200 parts of conductive inorganic fine particles C (average primary particle diameter: 0.61 μm, true specific gravity: 4.5) were used in place of the conductive inorganic fine particles A in Example 2. At this time, the conductive fine particles contained in the coating layer had the coverage of 70% to the core material.

The obtained [carrier 6] and [toner 1] were prepared into a developer by the same method as in Example 1, and the developer was evaluated in the same manner. The results are shown in Table 2.

Example 6

[Carrier 7] where D/h: 1.4, volume resistivity: 16.9 [Log (Ω·cm)], and magnetization: 65 $Am^2/kg$ was obtained in the same manner as in Comparative Example 1, except that the formulation of the coating layer was changed to that of the following ratio of an acrylic resin system and a silicone resin system in Comparative Example 1. At this time, the conductive fine particles contained in the coating layer had the coverage of 102% to the core material.

| | |
|---|---|
| Acrylic resin solution (solid content 50%) | 17.1 parts |
| Guanamine solution (solid content 70%) | 4.9 parts |
| Acidic catalyst (solid content 40%) | 0.10 parts |
| Silicone resin solution [Solid content 20% (SR2410: manufactured by Dow Corning Toray Silicone Co., Ltd.)] | 216.1 parts |
| Aminosilane [Solid content 100% (SH6020: manufactured by Dow Corning Toray Silicone Co., Ltd.)] | 1.71 parts |
| Conductive inorganic fine particles B: average primary particle diameter: 0.27 μm (true specific gravity: 4.2) | 120 parts |

The obtained [carrier 7] and [toner 1] were prepared into a developer by the same method as in Example 1, and the developer was evaluated in the same manner. The results are shown in Table 2.

Example 7

[Carrier 8] where D/h: 1.1 and volume resistivity: 13.7 [Log (Ω·cm)] was obtained in the same manner as in Example 2, except that the conductive inorganic fine particles A were reduced from 145 parts to 120 parts in Example 2. The fine particles contained in the coating layer had the coverage of 58% to the core material.

The obtained [carrier 8] and [toner 1] were prepared into a developer by the same method as in Example 1, and the developer was evaluated in the same manner. The results are shown in Table 2.

Example 8

[Carrier 9] where D/h: 1.1 and volume resistivity: 13.9 [Log (Ω·cm)] was obtained in the same manner as in Example 2, except that 36 μm calcined ferrite (true specific gravity 5.4) having a low magnetization was used and magnetization was changed to 35 $Am^2/kg$ in Example 2. The inorganic oxide particles contained in the coating layer had the coverage of 71% to the core material.

The obtained [carrier 9] and [toner 1] were prepared into a developer by the same method as in Example 1, and the developer was evaluated in the same manner. The results are shown in Table 2.

Example 9

[Carrier 10] where D/h: 1.1 and volume resistivity: 14.1 [Log (Ω·cm)] was obtained in the same manner as in Example 2, except that 35 μm calcined ferrite (true specific gravity 5.5) having a high magnetization was used and magnetization was changed to 93 $Am^2/kg$ in Example 2. The inorganic oxide particles contained in the coating layer had the coverage of 71% to the core material.

The obtained [carrier 10] and [toner 1] were prepared into a developer by the same method as in Example 1, and the developer was evaluated in the same manner. The results are shown in Table 2.

Example 10

[Carrier 11] where D/h: 1.4, volume resistivity: 14.8 [Log (Ω·cm)], and magnetization: 67 $Am^2/kg$ was obtained in the same manner as in Comparative Example 1, except that the formulation of the coating layer was changed to that of the following ratio of an acrylic resin system and a silicone resin system in Comparative Example 1. At this time, the conductive fine particles contained in the coating layer had the coverage of 85% to the core material.

| | |
|---|---|
| Acrylic resin solution (solid content 50%) | 17.1 parts |
| Guanamine solution (solid content 70%) | 4.9 parts |
| Acidic catalyst (solid content 40%) | 0.10 parts |
| Silicone resin solution [Solid content 20% (SR2410: manufactured by Dow Corning Toray Silicone Co., Ltd.)] | 216.1 parts |
| Aminosilane [Solid content 100% (SH6020: manufactured by Dow Corning Toray Silicone Co., Ltd.)] | 1.71 parts |
| Conductive inorganic fine particles B: average primary particle diameter: 0.27 μm (true specific gravity: 4.2) | 100 parts |

The obtained [carrier 11] and [toner 1] were prepared into a developer by the same method as in Example 1. The developer was subjected to sand blasting, and the developer was evaluated in the same manner as in Example 1 using a developing sleeve having a surface roughness Ra of 2.6 μm. The results are shown in Table 2.

Example 11

[Carrier 6] obtained in Example 5 and [toner 1] were prepared into a developer by the same method as in Example 1, the developer was subjected to electromagnetic blasting, and the developer was evaluated in the same manner as in Example 1 using a developing sleeve having a surface roughness Ra of 0.7 μm. The results are shown in Table 2.

Comparative Example 2

[Carrier 12] where D/h: 2.2, volume resistivity: 11.1 [Log (Ω·cm)], and magnetization: 68 $Am^2/kg$ was obtained in the same manner as in Example 2, except that the formulation of the coating layer was changed to that of the following ratio of an acrylic resin system and a silicone resin system in Example 2. At this time, the conductive fine particles contained in the coating layer had the coverage of 73% to the core material.

| | |
|---|---|
| Acrylic resin solution (solid content 50%) | 17.1 parts |
| Guanamine solution (solid content 70%) | 4.9 parts |
| Acidic catalyst (solid content 40%) | 0.10 parts |
| Silicone resin solution [Solid content 20% (SR2410: manufactured by Dow Corning Toray Silicone Co., Ltd.)] | 216.1 parts |
| Aminosilane [Solid content 100% (SH6020: manufactured by Dow Corning Toray Silicone Co., Ltd.)] | 1.71 parts |
| Conductive inorganic fine particles A: average primary particle diameter: 0.43 μm (true specific gravity: 4.6) | 150 parts |

The obtained [carrier 12] and [toner 1] were prepared into a developer by the same method as in Example 1, and the developer was evaluated in the same manner. The results are shown in Table 2.

Comparative Example 3

[Carrier 11] obtained in Example 10 and [toner 1] were prepared into a developer by the same method as in Example 1, the developer was subjected to sand blasting, and the developer was evaluated in the same manner as in Example 1 using a developing sleeve having a surface roughness Ra of 2.8 μm. The results are shown in Table 2.

Combative Example 4

[Carrier 6] obtained in Example 5 and [toner 1] were prepared into a developer by the same method as in Example 1, the developer was subjected to electromagnetic blasting, and the developer was evaluated in the same manner as in Example 1 using a developing sleeve having a surface roughness Ra of 0.5 μm. The results are shown in Table 2.

Example 12

[Carrier 13] where D/h: 1.1 and volume resistivity: 13.5 [Log (Ω·cm)] was obtained in the same manner as in Example 2, except that stannous octoate (Neostann U-28, manufactured by NITTO KASEI CO., LTD.) was used as a catalyst of the silicone resin solution in Example 2. The inorganic oxide particles contained in the coating layer had the coverage of 71% to the core material.

The obtained [Carrier 13] and [toner 1] were prepared into a developer by the same method as in Example 1, and the developer was evaluated in the same manner. The results are shown in Table 2.

Example 13

[Carrier 14] where D/h: 1.1 and volume resistivity: 13.3 [Log (Ω·cm)] was obtained in the same manner as in Example 2, except that titanium chelate (Orgatics TC-750, manufactured by Matsumoto Fine Chemical Co., Ltd.) was used as a catalyst of the silicone resin solution in Example 2. The inorganic oxide particles contained in the coating layer had the coverage of 71% to the core material.

The obtained [carrier 14] and [toner 1] were prepared into a developer by the same method as in Example 1, and the developer was evaluated in the same manner. The results are shown in Table 2.

Example 14

[Carrier 15] where D/h: 1.1 and volume resistivity: 13.8 [Log (Ω·cm)] was obtained in the same manner as in Example 2, except that titanium alkoxide (Orgatics TA-25, manufactured by Matsumoto Fine Chemical Co., Ltd.) was used as a catalyst of the silicone resin solution in Example 2. The inorganic oxide particles contained in the coating layer had the coverage of 71% to the core material.

The obtained [carrier 15] and [toner 1] were prepared into a developer by the same method as in Example 1, and the developer was evaluated in the same manner. The results are shown in Table 2.

Example 15

[Carrier 16] where D/h: 1.1 and volume resistivity: 13.1 [Log (Ω·cm)] was obtained in the same manner as in Example 2, except that zirconium chelate (Orgatics ZC-150, manufactured by Matsumoto Fine Chemical Co., Ltd.) was used as a catalyst of the silicone resin solution in Example 2. The inorganic oxide particles contained in the coating layer had the coverage of 71% to the core material.

The obtained [carrier 16] and [toner 1] were prepared into a developer by the same method as in Example 1, and the developer was evaluated in the same manner. The results are shown in Table 2.

Example 16

[Carrier 17] where D/h: 1.1 and volume resistivity: 14.7 [Log (Ω·cm)] was obtained in the same manner as in Example 2, except that the conductive inorganic fine particles A were reduced from 145 parts to 100 parts in Example 2. The fine particles contained in the resin coating layer had the coverage of 49% to the core material.

The obtained [toner 1] and [carrier 17] were prepared into a developer by the same method as in Example 1, and the developer was evaluated in the same manner. The results are shown in Table 2.

TABLE 1

| | Carrier | Toner | Ra/D | D/h | Developing sleeve surface treatment | Carrier volume resistivity (log Ω · cm) | Core surface coverage (%) | Carrier magnetic moment ($Am^2/kg$) |
|---|---|---|---|---|---|---|---|---|
| Example 1 | Carrier 1 | Toner 1 | 2.8 | 1.23 | Electromagnetic blasting | 12.9 | 71 | 68 |
| Example 2 | Carrier 2 | Toner 1 | 2.8 | 1.13 | Electromagnetic blasting | 13.1 | 71 | 68 |
| Comparative Example 1 | Carrier 3 | Toner 1 | 4.4 | 0.79 | Electromagnetic blasting | 15.8 | 85 | 66 |
| Example 3 | Carrier 4 | Toner 1 | 2.8 | 1.95 | Electromagnetic blasting | 11.6 | 73 | 68 |
| Example 4 | Carrier 5 | Toner 1 | 2.8 | 1.13 | Electromagnetic blasting | 9.5 | 102 | 68 |
| Example 5 | Carrier 6 | Toner 1 | 2.0 | 1.61 | Electromagnetic blasting | 12.4 | 70 | 68 |
| Example 6 | Carrier 7 | Toner 1 | 4.4 | 1.42 | Electromagnetic blasting | 16.9 | 102 | 65 |
| Example 7 | Carrier 8 | Toner 1 | 2.8 | 1.13 | Electromagnetic blasting | 13.7 | 58 | 68 |
| Example 8 | Carrier 9 | Toner 1 | 2.8 | 1.13 | Electromagnetic blasting | 13.9 | 71 | 35 |
| Example 9 | Carrier 10 | Toner 1 | 2.8 | 1.13 | Electromagnetic blasting | 14.1 | 71 | 93 |
| Example 10 | Carrier 11 | Toner 1 | 9.7 | 1.42 | Sand blasting | 14.8 | 85 | 67 |
| Example 11 | Carrier 6 | Toner 1 | 1.1 | 1.61 | Electromagnetic blasting | 12.4 | 70 | 68 |
| Example 12 | Carrier 13 | Toner 1 | 2.8 | 1.13 | Electromagnetic blasting | 13.5 | 71 | 68 |
| Example 13 | Carrier 14 | Toner 1 | 2.8 | 1.13 | Electromagnetic blasting | 13.3 | 71 | 68 |
| Example 14 | Carrier 15 | Toner 1 | 2.8 | 1.13 | Electromagnetic blasting | 13.8 | 71 | 68 |
| Example 15 | Carrier 16 | Toner 1 | 2.8 | 1.13 | Electromagnetic blasting | 13.1 | 71 | 68 |
| Comparative Example 2 | Carrier 12 | Toner 1 | 2.8 | 2.15 | Electromagnetic blasting | 11.1 | 73 | 68 |
| Comparative Example 3 | Carrier 11 | Toner 1 | 10.4 | 1.42 | Sand blasting | 14.8 | 85 | 67 |
| Comparative Example 4 | Carrier 6 | Toner 1 | 0.8 | 1.61 | Electromagnetic blasting | 12.4 | 70 | 68 |
| Example 16 | Carrier 17 | Toner 1 | 2.8 | 1.13 | Electromagnetic blasting | 14.7 | 49 | 68 |

The powder resistivities of Examples 1, 2, 3, 4, 7, 8, and 9 and Comparative Example 2 were 1.6, the powder resistivities of Examples 5 and 11, and Comparative Example 4 were 1.3, and the powder resistivities of Examples 6 and 10 and Comparative Examples 1 and 3 were 3.2.

TABLE 2

| | Initial evaluation | | | Durability (25° C., 50% RH) after 300,000 sheets | | | | |
|---|---|---|---|---|---|---|---|---|
| | | Carrier adhesion | | | | Carrier adhesion | | |
| | Image density | Edge portion | White voids (image portion) | Amount of charge decrease (μC/g) | Amount of resistance decrease (log Ω · cm) | Edge portion | White voids (image portion) | Image density |
| Example 1 | A | A | A | 5 | 2.0 | A | B | A |
| Example 2 | A | A | A | 4 | 1.2 | A | A | A |

TABLE 2-continued

| | Initial evaluation | | | Durability (25° C., 50% RH) after 300,000 sheets | | | | |
|---|---|---|---|---|---|---|---|---|
| | | Carrier adhesion | | | | Carrier adhesion | | |
| | Image density | Edge portion | White voids (image portion) | Amount of charge decrease (μC/g) | Amount of resistance decrease (log Ω · cm) | Edge portion | White voids (image portion) | Image density |
| Comparative Example 1 | A | B | A | 8 | 4.1 | B | D | B |
| Example 3 | A | A | A | 4 | 2.7 | A | B | A |
| Example 4 | A | A | B | 5 | 0.9 | A | B | A |
| Example 5 | A | A | A | 4 | 0.8 | A | A | A |
| Example 6 | A | B | A | 5 | 2.4 | B | A | A |
| Example 7 | A | A | A | 6 | 2.1 | A | A | A |
| Example 8 | A | B | A | 4 | 1.1 | B | B | A |
| Example 9 | B | A | A | 3 | 2.8 | A | B | B |
| Example 10 | A | B | A | 7 | 2.1 | B | A | B |
| Example 11 | B | B | A | 5 | 1.0 | B | A | B |
| Example 12 | A | A | A | 4 | 0.8 | A | A | A |
| Example 13 | A | A | A | 4 | 1.0 | A | A | A |
| Example 14 | A | A | A | 4 | 1.3 | A | A | A |
| Example 15 | A | A | A | 4 | 0.9 | A | A | A |
| Comparative Example 2 | A | A | B | 11 | 4.5 | A | C | A |
| Comparative Example 3 | A | C | A | 8 | 2.7 | D | B | C |
| Comparative Example 4 | B | C | B | 6 | 1.4 | D | A | C |
| Example16 | B | A | A | 3 | 2.1 | B | A | B |

The results of Table 2 show that Examples 1 to 16 brought excellent results in terms of all evaluation items of image density, carrier adhesion, the amount of charge decrease, and the amount of resistance decrease.

In contrast, Comparative Example 1 showed a large decrease in resistance, showed a large amount of carrier adhesion in the solid portion after 300,000 sheets, and was not at an allowable level.

Also, Comparative Example 2 had a large amount of charge decrease and a large amount of resistance decrease, was also inferior in the amount of carrier adhesion in the solid portion after 300,000 sheets, and was inadequate for practical use.

Also, Comparative Examples 3 and 4 were inferior in the amount of carrier adhesion to the edge portion, and the result was determined to be impractical for use.

As above, it has been found that the image forming processes using the carriers and developing devices shown in Examples allow obtaining very stable high-quality images for a long period of time.

What is claimed is:

1. A developing device comprising:

a two-component developer comprising a magnetic carrier and a toner;

a developer bearing member comprising a nonmagnetic developing sleeve configured to bear the two-component developer on a surface thereof while rotating;

a magnetic field generating unit fixed inside of the nonmagnetic developing sleeve; and a developer amount control member configured to control an amount of the two-component developer borne on the developer bearing member, wherein the magnetic carrier comprises a core material, and a coating layer coated on the core material and comprising a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D]<10.0$, where Ra denotes a surface roughness of the developing sleeve.

2. The developing device according to claim 1, wherein the core material has coverage of 70% or more with the conductive fine particles.

3. The developing device according to claim 1, wherein the developing sleeve has a surface processed by blasting.

4. The developing device according to claim 1, wherein the magnetic carrier has a volume resistivity of 10 [Log(Ω·cm)] to 16 [Log(Ω·cm)].

5. The developing device according to claim 1, wherein the magnetic carrier has a volume average particle diameter of 20 μm or more and 65 μm or less.

6. The developing device according to claim 1, wherein the binder resin comprises a silicone resin.

7. The developing device according to claim 1, wherein the binder resin comprises an acrylic resin and a silicone resin.

8. The developing device according to claim 1, wherein the magnetic carrier has a magnetic moment of 40 $Am^2/kg$ to 90 $Am^2/kg$ or less at 1,000 $10^3/4\pi \cdot A/m$.

9. An image forming apparatus comprising:

a latent electrostatic image bearing member;

a latent electrostatic image forming unit configured to form a latent electrostatic image on the latent electrostatic image bearing member;

a developing unit configured to develop the latent electrostatic image using a toner so as to form a visible image;

a transferring unit configured to transfer the visible image onto a recording medium; and a fixing unit configured to fix the transferred image onto the recording medium, wherein the developing unit comprises:

a two-component developer comprising a magnetic carrier and the toner;

a developer bearing member comprising a nonmagnetic developing sleeve configured to bear the two-component developer on a surface thereof while rotating;

a magnetic field generating unit fixed inside of the nonmagnetic developing sleeve; and a developer amount control member configured to control an amount of the two-component developer borne on the developer bearing member, wherein the magnetic carrier comprises a core material, and a coating layer coated on the core material and comprising a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D]<10.0$, where Ra denotes a surface roughness of the developing sleeve.

10. A process cartridge comprising:

a latent electrostatic image bearing member; and a developing unit configured to develop a latent electrostatic image formed on the latent electrostatic image bearing member using a toner so as to form a visible image, wherein the process cartridge is detachably mounted to an image forming apparatus body, wherein the developing unit comprises:

a two-component developer comprising a magnetic carrier and the toner;

a developer bearing member comprising a nonmagnetic developing sleeve configured to bear the two-component developer on a surface thereof while rotating;

a magnetic field generating unit fixed inside of the nonmagnetic developing sleeve; and a developer amount control member configured to control an amount of the two-component developer borne on the developer bearing member, wherein the magnetic carrier comprises a core material, and a coating layer coated on the core material and comprising a binder resin and conductive particles, and wherein the magnetic carrier satisfy a ratio D/h of $1.00<[D/h]\leqq 1.95$, where D denotes an average primary particle diameter of the conductive fine particles, and h denotes a thickness of the coating layer, and a ratio Ra/D of $1.0<[Ra/D]<10.0$, where Ra denotes a surface roughness of the developing sleeve.

* * * * *

UNITED STATES PATENT AND TRADEMARK OFFICE

CERTIFICATE OF CORRECTION

PATENT NO. : 7,835,677 B2
APPLICATION NO. : 12/402086
DATED : November 16, 2010
INVENTOR(S) : Koichi Sakata et al.

It is certified that error appears in the above-identified patent and that said Letters Patent is hereby corrected as shown below:

On the title page, Item (75), the first inventor's address is incorrect. Item (75) should read:

(75) Inventors: Koichi Sakata, Sunto-gun (JP); Tomio Kondou, Numazu (JP); Shinichiro Yagi, Numazu (JP)

Signed and Sealed this
Fifth Day of April, 2011

David J. Kappos

David J. Kappos
*Director of the United States Patent and Trademark Office*